US005251896A

United States Patent [19]

Gerlach

[11] Patent Number: 5,251,896

[45] Date of Patent: Oct. 12, 1993

[54] GOLF CLUB SHAFT MADE FROM FIBRE-REINFORCED PLASTIC

[75] Inventor: Thomas K. Gerlach, Frankfurt am Main, Fed. Rep. of Germany

[73] Assignee: Sportex GmbH & Co., Neu-Ulm, Fed. Rep. of Germany

[21] Appl. No.: 778,528

[22] Filed: Oct. 18, 1991

[30] Foreign Application Priority Data

Oct. 22, 1990 [DE] Fed. Rep. of Germany ..... 4033553

[51] Int. Cl.[5] ..... A63B 53/10

[52] U.S. Cl. ..... 273/80 B; 273/DIG. 7; 273/DIG. 23

[58] Field of Search ..... 273/80 B, DIG. 7, DIG. 23, 273/80 R; 428/34.1, 34.6; 43/18.1, 18.5; 156/173, 189

[56] References Cited

U.S. PATENT DOCUMENTS

| | | | |
|---|---|---|---|
| 1,528,017 | 3/1925 | Gammeter | 273/80 R X |
| 1,565,069 | 12/1925 | Edwards | 273/80 R |
| 1,781,116 | 11/1930 | Link et al. | 273/80 R |
| 1,950,342 | 3/1934 | Meshel | 273/80 B |
| 2,086,275 | 7/1937 | Lemmon | 273/80 R |
| 3,313,541 | 4/1967 | Benkoczy et al. | 273/80 R |
| 3,646,610 | 2/1972 | Jackson | 273/80 R |
| 3,998,458 | 12/1976 | Inoue et al. | 273/DIG. 23 X |
| 4,000,896 | 1/1977 | Lauraitis | 273/DIG. 23 X |
| 4,082,277 | 4/1978 | Van Auken | 273/80 R |
| 4,097,626 | 6/1978 | Tennent | 273/DIG. 7 X |
| 4,135,035 | 1/1979 | Branen et al. | 273/80 B X |
| 4,157,181 | 6/1979 | Cecka | 273/DIG. 23 X |
| 4,319,750 | 3/1982 | Roy | 273/80 B |
| 5,143,374 | 9/1992 | Shibasaki | 273/80 B |

FOREIGN PATENT DOCUMENTS

| | | | |
|---|---|---|---|
| 518699 | 3/1940 | United Kingdom | 273/80 B |
| 1078412 | 8/1967 | United Kingdom | 273/167 E |
| 2040693 | 9/1980 | United Kingdom | 273/80 B |
| 2053004 | 2/1981 | United Kingdom | 273/80 B |

*Primary Examiner*—V. Millin
*Assistant Examiner*—Sebastiano Passaniti
*Attorney, Agent, or Firm*—McAulay Fisher Nissen Goldberg & Kiel

[57] ABSTRACT

In a fibre-reinforced plastic golf club shaft, which has at the bottom an end portion for attaching a club head and at the top an end portion for attaching a grip and which is constructed in the form of a hollow profile. The cross-section of the profile is not constant over the shaft length and is provided with a shape, which is symmetrical to a median plane passing through the longitudinal axis of the shaft in the driving direction. The flex point of the shaft is in the area between the two end portions.

Over the shaft length, the shaft has a cross-sectional configuration such that, starting from the flex point and passing towards each of the two end portions, the resisting moment of the cross-sectional surface of the shaft at right angles to the median longitudinal axis relative to the axis passing through the median longitudinal axis of the shaft and at right angles to the golf club driving direction decreases with increasing distance from the flex point (F) until reaching a minimum resisting moment on entering the particular end portion or close to the latter.

9 Claims, 2 Drawing Sheets

GOLF CLUB SHAFT MADE FROM FIBRE-REINFORCED PLASTIC

BACKGROUND OF THE INVENTION

The invention relates to golf club shaft made from fibre-reinforced plastic, with a portion for the attachment of a club head provided in its lower end region and a portion for the attachment of a grip provided on its upper end region, the shaft forming a hollow profile, whose cross-section is not constant over the shaft length and has a symmetrical shaping to a median plane passing through the longitudinal axis of the shaft in the drive direction and with a flex point in the area between the two portions used for attaching a club head or a grip.

The use characteristics of a golf club are inter alia decisively influenced by the material of the club shaft and the design of the latter.

It is known to construct golf clubs with a solid wooden shaft. Such golf clubs were widely used in earlier times. However, of late, increasing use is being made of golf clubs, in which the shaft is constituted by a stainless steel tube or a fibre-reinforced tube having a circular cross-section and which at least over part of the shaft length between the grip and the club head tapers in the direction of the latter. The taper can take place conically or stepwise by fitting into one another tubular portions of decreasing cross-section and it is even possible to combine together tubular portions made from different materials (metal, fibre-reinforced plastic) (European patent 258 233).

It is fundamentally desirable in a golf club for its weight to be as low as possible, which can be achieved in the case of shafts made from fibre-reinforced plastic. However, it is simultaneously desirable for there to be a clearly defined resilience (rigidity) of the club shaft when driving.

Hitherto known golf club shafts made from fibre-reinforced plastic are constituted by a circular tube (e.g. U.S. Pat. No. 3,998,458 and German patent 23 48 011) and have a relatively great flexibility, which impairs the precision of the drive in both the vertical and horizontal direction and it is scarcely possible to accurately control the trajectory of the ball. On driving the shaft initially bends in a first portion of the driving, movement counter to the driving direction, so that the club head trails somewhat in the latter. This rearward bending of the shaft is cancelled out again in a second portion of the driving movement and then in a third portion of the latter, which starts directly before ball contact, the shaft bends forwards in the direction of movement. If ball contact (tee-shot) takes place in this phase, there are changes to the ball take-off angle predetermined by the club head inclination and which consequently changes in an uncontrollable manner. The take-off speed of the driven ball also suffers as a result of the energy loss caused by the shaft deformation. The point along the shaft where the maximum shaft deflection occurs on driving (relative to the connecting line between the start and finish of the shaft) is known as the flex point.

As the nodal point of vibration of the vibrations on the club occuring on driving is directly below the hands or the handle, in the known, fibre-reinforced plastic club shafts, considerable jolting occurs on the forearm of the golfer.

A primary object of the invention is therefore to so improve a fibre-reinforced plastic hollow shaft for a golf club in such a way that for the same club loading when driving there are reduced deformations of the club shaft compared with conventional fibre-reinforced plastic club shafts and it is consequently possible to more accurately determine the ball take-off angle on driving, while obtaining an increased ball take-off speed.

SUMMARY OF THE INVENTION

According to the invention this is achieved in a shaft of the aforementioned type in that its cross-sectional configuration over the shaft length is such that considered from the flex point in the direction of the two end portions the resisting moment related to the axis running through the shaft median longitudinal axis and at right angles to the driving direction of the golf club of the cross-sectional surface of the shaft at right angles to the median longitudinal axis decreases with increasing distance from the flex point until the reaching of a minimum resisting moment on entering the particular end portion (for fixing the club head or grip) or at a limited distance therefrom. Starting from the flex point, the resisting moment of the club head preferably decreases to the end portion on which the club head is attached, while on the other side it only decreases up to a cross-section, which is at a distance of max. 10 cm from the end portion for attaching the grip. The resisting moment is defined as the quotient of the angular impulse I of the cross-section relative to the reference axis and the distance $\alpha_{max}$ between the reference axis and the cross-section point furthest removed therefrom: $W = I\ \alpha_{max}$.

The inventive shaft with its completely novel design, in which, starting from the handle, initially the resisting moment increases towards the flex point and then decreases again behind the same surprisingly has excellent driving characteristics during the swing. Thus, when performing the stroke or drive there is a considerably reduced shaft deformation and consequently the improvement to the rigidity obtained through the special shaping of the shaft, accompanied by a minimum club weight leads to a more precise performance of the drive, i.e. an improved predetermination of the ball trajectory, accompanied by an increased torsional rigidity, a higher ball take-off speed, a greater resiliency in the case of imprecise striking of the ball and a much improved vibration absorptivity. As a result of the greater shaft rigidity in the case of the invention, there are also only minor vibration amplitudes during the subsequent vibration and consequently only minor jolting occurs on the golfer's forearm.

The flex point of a golf club shaft can easily be measured in that the two ends of the shaft are fixed in an articulated, pivotable manner and pressed against one another, accompanied by the simultaneous bending out of the shaft, until the maximum bending out of the shaft median axis (measured relative to the connection of the two end points of the median longitudinal axis at both ends of the shaft) reaches 10% of the shaft length. The flex point in the sense of the inventive teaching occurs at the point of maximum bending out.

According to an advantageous further development of the invention the design of the shaft is chosen in such a way that, starting from the flex point, the resisting movement of the shaft cross-section decreases on the side of the handle and extends up to the minimum value, which is greater than the value of the smallest resisting moment on the other side of the shaft facing the club head.

Another, especially preferred development of the invention comprises, in the case of the inventive shaft, the resisting moment of the shaft cross-section decreasing on the side of the flex point on which the grip is located until reaching a minimum cross-section (with an associated minimum resisting moment), which is at a distance of max 10 cm ahead of the grip-side end portion and from said minimum cross-section the further shaft portion in the direction of the grip-side end portion is at least the same (and is preferably constructed in the form of a cylindrical ring portion).

According to another advantageous embodiment of the inventive golf club shaft, the maximum resisting moment of the shaft at the flex point has a value which is 1.35 to 1.40 times the minimum resisting moment of the shaft on the side on which is located the grip-side end portion of the shaft.

The construction of the inventive golf club shaft with a resisting moment decreasing to both sides from the flex point can take place in any appropriate manner, e.g. in stepwise manner. However, it is particularly preferred for the shaft according to the invention to be designed in such a way that the decrease of the resisting moment from the flex point to either side of the shaft takes place in a constant manner.

A particularly advantageous further development of the invention comprises the shaft cross-section at the flex point having a tear-shaped profile, which is located with its rounded front side in the shaft driving direction. The tear-shaped profile, which forms an airfoil section, not only leads to reduced air resistance when making the stroke, but also stabilizes the club when swinging in the forwards direction, which permits an even more precise performance of the stroke with an even greater improvement to the control of the ball take-off angle on the part of the golfer. However, similar advantages can be obtained with another preferred embodiment of the inventive golf club shaft, which comprises the shaft cross-section at the flex point forming a profile shape, which has three portions, namely a central portion in the form of a circular ring portion, which is followed at the front and rear, considered in the driving direction, by a portion with a substantially triangular profile, which is rounded at its tip and in each case the base of the corresponding triangle faces the central portion.

Preferably, in the case of the golf club shaft according to the invention, the two cross-sections at which the smallest resisting moment on the shaft is reached on either side of the flex point are constructed in the form of a circular ring and on the side on which the club head is located, the ring cross-section corresponding to the minimum resisting moment has a smaller ring external diameter and a smaller resisting moment than the ring cross-section located on the other side of the flex point and with the smallest resisting moment located there.

The construction of the internal cavity of the inventive shaft can take place in numerous different ways. Preferably, over the entire shaft length, the cavity within the shaft is constructed as a constant cross-section, cylindrical cavity, or as a cavity having a cross-section, which conically tapers from the grip-side end portion to the club head-side end portion.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
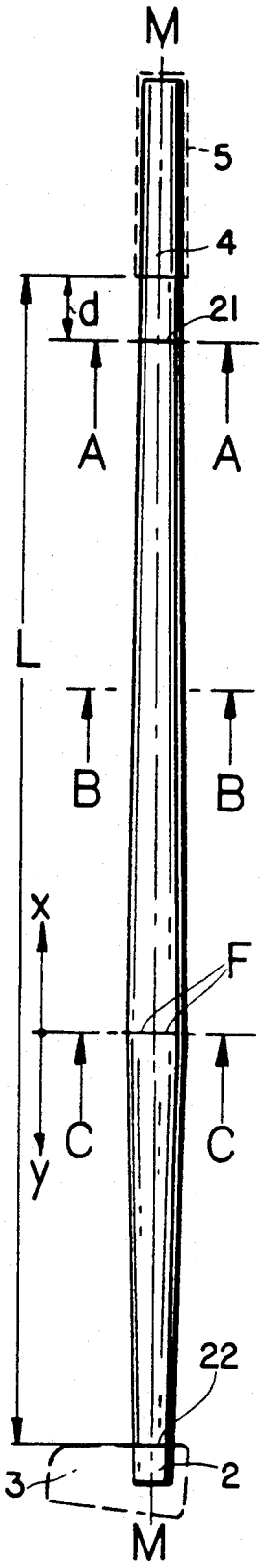
FIG. 1—A perspective view of an inventive shaft for a golf club (with the grip and club head indicated in broken line form) in a view from the front (i.e. counter to the driving direction).

FIG. 1 shows a shaft 1 for a golf club, which is provided at its front end region (lower end region) with an end portion 2 for mounting or fixing a club head 3 (shown in broken line form in the drawings), as well as at its other, upper end region a further end portion 4, on which can be mounted and fixed a grip in the form of a handle 5 (only shown in broken line form in the drawings).

Within the area between the two end portions 2, 4, the shaft 1 has a so-called flex point F, which represents the point of maximum deflection on bending the club during driving and can be determined in that the two ends of the shaft 1 are moved towards one another, accompanied by the lateral bending out of the shaft, until the bending out of the shaft, relative to the connecting line of the two shaft ends, represents 10% of the shaft length. At the point of the then occurring maximum bending out is located the flex point.

The construction of the cross-section of the shaft (considered in a plane at right angles to the median longitudinal axis M—M of the shaft 1) along the length L of the shaft portion between the two end portions 2, 4 is as follows in the case of a shaft embodiment according to FIG. 1. Starting from the flex point F, the cross-section of the shaft to either side changes with increasing distance x (in the direction of the grip side end portion 4) or increasing distance y (in the direction of the club head-side end portion 2) in such a way that the resisting moment of the profile cross-sections, in each case related to an axis Z—Z (cf. FIGS. 3 to 8) oriented at right angles to the golf club driving direction s and passing through the median longitudinal axis M—M of the shaft 1 continuously decreases. This resisting moment decrease, which is accompanied by a reduction in the cross-section, takes place on the side of the flex point F, which is towards the club head 3 and up to the lower end portion 2, a minimum resisting moment $W_{min2}$ being reached there, while on the other side of the flex point F the resisting moment only decreases up to a point 21, which is at a distance d from the lower end of the upper end portion 4 and where on said side of the flex point F, there is a minimum resisting moment $W_{min1}$. The distance d is max 10 cm and along this distance the cross-section of the shaft 1 is constant, namely in the form of a circular ring cross-section 9 (cf. FIGS. 3 or 6).

Figure 2:
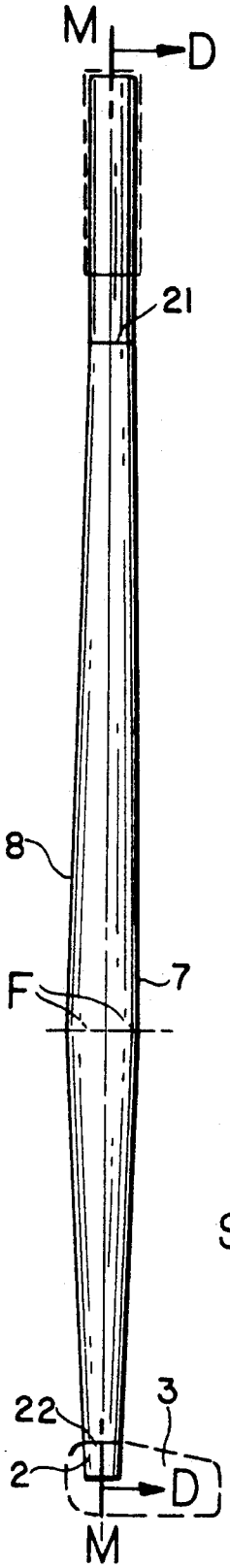
FIG. 2—A side view of the inventive club according to FIG. 1.
Figure 6:
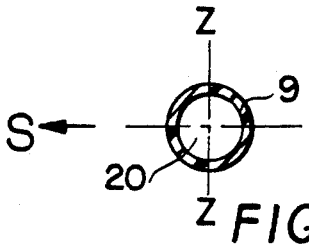
FIGS. 6, 7 and 8—Cross-sectional profiles of another embodiment of an inventive shaft at sections A—A, B—B or C—C (once again turned by 90°).
Figure 7:
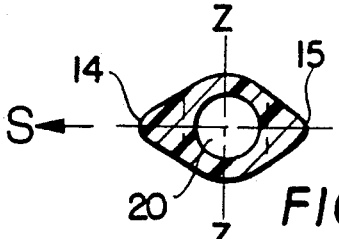
Figure 8:
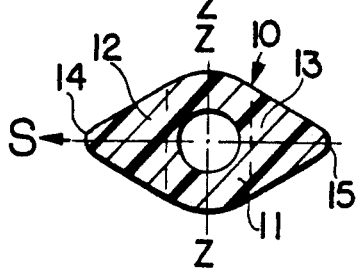
Figure 9:
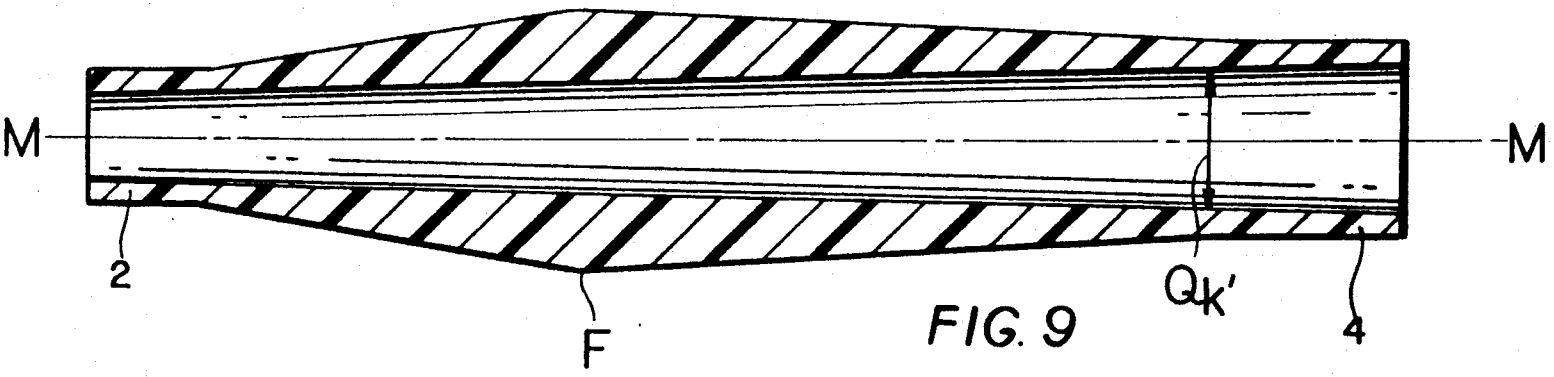
FIG. 9—A sectional representation according to D—D in FIG. 2.
Figure 10:
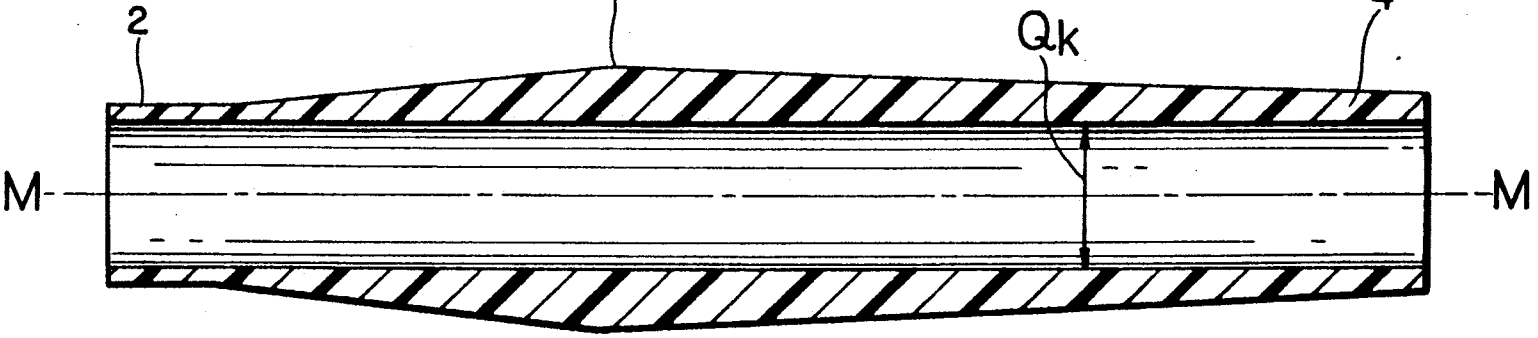
FIG. 10—The same sectional representation as in FIG. 9, but for a somewhat modified embodiment.

Over its entire length the shaft is provided with an inner cavity 20. The diameter of the inner cavity 20 over the shaft length is either constant or decreases continuously towards the lower shaft end. FIG. 10, as well as FIGS. 6 to 8 show that the cross-section $Q_k$ of the inner cavity or bore 20 is constant, while in FIG. 9 the cross-section $Q_k$, continuously decreases over the length of the shaft 1 from the grip-side end region to the lower, club head-side end region. FIGS. 9 and 10 merely provide a fundamental representation and the scale proportions do not correspond to the factual proportions, which also applies with respect to FIGS. 1 and 2.

Figure 3:
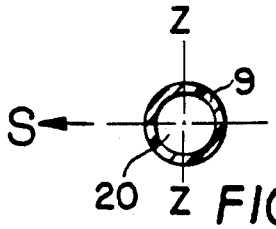
FIGS. 3, 4 and 5—Sections A—A, B—B or C—C from FIG. 1 (in each case turned by 90°).

At the two points 21, 22, on which on either side of the flex point F the resisting moment of the local shaft cross-section continuously decreasing therefrom reaches its minimum value (namely minimum resisting moment $W_{min2}$ at point 22 on entering the lower end portion 2 or the minimum resisting moment $W_{min1}$ at point 21 at distance d from the lower end of the upper end portion 4), the cross-section of the shaft 1 is in each case constructed in the form of a circular ring, as can be gathered from FIGS. 3 and 6. The external diameter of the circular ring 9 (cf. FIGS. 3 and 6) and the resisting moment of this circular ring face at point 21 is larger than the external diameter of the corresponding circular ring face at point 22 and its resisting moment $W_{min2}$.

FIGS. 3 to 5 or 6 to 8 show two different constructions for the cross-sectional profile of the shaft diameter at the points of the sections A—A, B—B or C—C in FIG. 1 and the sectional representations are in each case shown turned 90° to the right in their sectional position.

Figure 4:
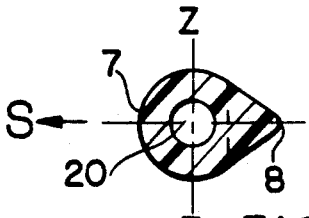
Figure 5:
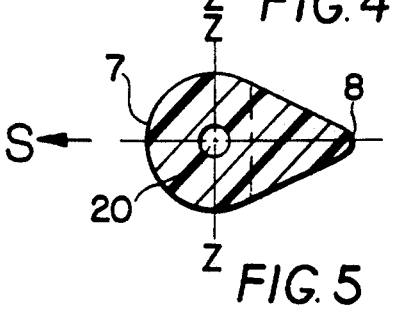

In the profile form as shown in FIGS. 3 to 5, in the flex point F there is a tear-shaped hollow profile (cf. FIG. 5), which in its front region directed in the driving direction s has a semicircular rounded part 7, which tapers in triangular form in the rear profile region, the tip or apex 8 of the triangle being rounded (cf. FIGS. 5 and 6). With respect to the design or shaping, particular reference is made to FIGS. 3 to 5 in this connection. Between the profile with the maximum resisting moment at the flex point F and the minimum resisting moment circular ring profile 9, as shown in FIG. 3, there is a continuous, constant change to the profile shape, as is apparent from the intermediate section of FIG. 4, which at point B—B, is roughly at half the distance between the flex point F and the point 21. Thus, between the point 21 with the minimum, circular ring-shaped cross-section 9 of minimum resisting moment $W_{min1}$ and the cross-section of maximum resisting moment at flex point F (cf. FIG. 5), there is a continuous shape change of the profile cross-section up to the formation of the tear-shaped profile at flex point F (FIG. 5).

On the other side of the flex point F, there is in principle a similar profile shape change, namely from the profile according to FIG. 5 (in flex point F) to the circular ring profile, which is present at the point 22, much as at point 21, but with a smaller external cross-section and smaller resisting moment. This tear-shaped profile, whose front side 7 is directed in the driving direction s and whose rear side is directed counter to the driving direction, forms an airfoil section, which during driving stabilizes the entire shaft 1 in the driving direction, so that the drive or stroke can be performed particularly accurately.

A somewhat different shaping of the profile is shown in FIGS. 6 to 8. It differs from the profile shape of FIGS. 3 to 5 in that in this case, once again starting from an equally large circular ring end cross-section at the minimum resisting moment points 21 or 22 (corresponding to FIG. 6 for point 21), the continuous profile shape change takes place in such a way that in flex point F a profile shape 10 is reached, as shown in FIG. 8 and express reference is again made to the shaping shown therein. The profile shape 10 comprises three regions, namely a central region 11, which comprises a circular ring portion and towards the front or rear side (in each case in the driving direction s) passes into a substantially triangular projection 12 or 13, rounded at its apex 14 or 15 and whose base is connected to the central region 11. The change from the circular cross-sections at points 21 and 22 to the cross-section at the flex point F again takes place in a continuous, constant manner. Thus, FIG. 7 shows a cross-section at point B—B, roughly in the centre of the distance between the flex point and the point 21, which reproduces such an intermediate profile.

The shaft shown in the drawings is made from fibre-reinforced plastic and the fibres can be of glass, aramide, ceramics, boron, plastics, etc. The plastics can in particular be epoxy resins, polyester resins or thermoplastics.

While preferred embodiments of the present invention have been shown and described, it will be understood by those skilled in the art that various changes and modifications could be made without varying from the scope of the present invention. Consequently, various changes or modifications could be made without varying from the scope of the present invention.

What is claimed is:

1. A golf club shaft comprising:

a first end portion for the attachment of a club head provided in a lower end region and a second end portion for the attachment of a grip provided on an upper end region, said shaft forming a hollow profile and having a cross-section which is not constant over the shaft length and having a symmetrical shaping with respect to a median plane passing through the longitudinal axis for said shaft in a golf club drive direction and also having a flex point in an area between said first and second end portions, wherein over said shaft length, said shaft has a cross-sectional configuration such that, starting from said flex point and passing in the direction of each of said first and second end portions, the resisting moment of a cross-sectional surface of said shaft at right angles to the median longitudinal axis and related to the axis passing through the longitudinal axis of said shaft and at right angles to said golf club driving direction, constantly decreases with increasing distance from said flex point until reaching a minimum resisting moment on entering a particular end portion or close to said particular end portion, said shaft being composed of a fiber-reinforced plastic.

2. A golf club shaft according to claim 1, wherein the minimum resisting moment of the shaft cross-section at the second end portion of the shaft is greater than the minimum resisting moment at the first end portion of the shaft.

3. A golf club shaft according to claim 1, wherein the resisting moment of the cross-sectional surface of the hollow profile on the side towards said second end portion of the shaft decreases to a minimum cross-section, which is at a distance of maximum 10 cm ahead of said second end portion and from where the cross-section of said shaft remains the same in the direction towards said second end portion.

4. A golf club shaft according to claim 1, wherein the maximum resisting moment of the shaft at said flex point is 1.35 to 1.4 times the minimum resisting moment on the side where said second end portion of said shaft is located.

5. A golf club shaft according to claim 1, wherein the decrease of the resisting moment from the flex point towards said first and second end portions of said shaft takes place in a continuous manner.

6. A golf club shaft according to claim 1, wherein the cross-section of the shaft at the flex point is a tear-shaped profile including a rounded front side, said rounded front side being in the driving direction of the shaft.

7. A golf club shaft according to claim 1, wherein the two cross-sections, at which on either side of said flex point in each case a minimum resisting moment on the shaft is reached, have a circular ring shape and on the club head side, the ring cross-section having a smaller ring external diameter with smaller resisting moment than that of the grip-side ring cross-section.

8. A golf club shaft according to claim 1, wherein said shaft has an inner, cylindrical shaft cavity of constant cross-section formed over its entire length.

9. A golf club shaft according to claim 1, wherein said shaft has an inner shaft cavity along its entire length, whose cross-section conically tapers from the second end portion to the first end portion.

* * * * *